US010000906B2

(12) United States Patent
Wu

(10) Patent No.: US 10,000,906 B2
(45) Date of Patent: Jun. 19, 2018

(54) SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 371 days.

(21) Appl. No.: 14/697,713

(22) Filed: Apr. 28, 2015

(65) Prior Publication Data

US 2015/0240450 A1 Aug. 27, 2015

Related U.S. Application Data

(63) Continuation of application No. PCT/JP2013/071161, filed on Aug. 5, 2013.

(30) Foreign Application Priority Data

Nov. 9, 2012 (JP) ..... 2012-247868

(51) Int. Cl.
*E02F 9/12* (2006.01)
*F15B 21/14* (2006.01)
(Continued)

(52) U.S. Cl.
CPC ..... *E02F 9/123* (2013.01); *E02F 9/2217* (2013.01); *E02F 9/2267* (2013.01); *F15B 1/027* (2013.01); *F15B 11/08* (2013.01); *F15B 21/14* (2013.01); *F15B 2201/40* (2013.01); *F15B 2201/411* (2013.01); *F15B 2211/205* (2013.01); *F15B 2211/212* (2013.01); *F15B 2211/25* (2013.01); *F15B 2211/255* (2013.01); *F15B 2211/265* (2013.01); *F15B 2211/40584* (2013.01);
(Continued)

(58) Field of Classification Search
CPC ..... E02F 9/2217; F15B 1/024; F15B 21/14
USPC ..... 60/414
See application file for complete search history.

(56) References Cited

U.S. PATENT DOCUMENTS 6,981,371 B2 * 1/2006 Imanishi ..... E02F 9/2225 60/420
7,823,379 B2 * 11/2010 Hamkins ..... E02F 9/2217 60/414
(Continued)

FOREIGN PATENT DOCUMENTS

JP S56-170301 U 4/1981
JP S59-019122 U 6/1984
(Continued)

OTHER PUBLICATIONS

International Search Report dated Nov. 12, 2013 (PCT/JP2013/071159).
(Continued)

*Primary Examiner* — Thomas E Lazo
(74) *Attorney, Agent, or Firm* — IPUSA, PLLC

(57) ABSTRACT

A shovel may be provided with a swing hydraulic motor, a relief valve provided on the swing hydraulic motor, and an accumulator part that supplies to the swing hydraulic motor a working oil having a pressure lower than a relief pressure of the relief valve. The accumulator part may accumulate the working oil on a braking side of the swing hydraulic motor. The accumulator part may discharge the working oil to an upstream of a main pump.

12 Claims, 10 Drawing Sheets

(51) Int. Cl.
*E02F 9/22* (2006.01)
*F15B 1/027* (2006.01)
*F15B 11/08* (2006.01)

(52) U.S. Cl.
CPC . *F15B 2211/625* (2013.01); *F15B 2211/6309* (2013.01); *F15B 2211/6313* (2013.01); *F15B 2211/7058* (2013.01); *F15B 2211/715* (2013.01)

(56) References Cited

U.S. PATENT DOCUMENTS

| | | | | |
|---|---|---|---|---|
| 8,776,511 | B2 * | 7/2014 | Zhang | F15B 21/14 60/410 |
| 2003/0115863 | A1 | 6/2003 | Holt et al. | |
| 2007/0074509 | A1 | 4/2007 | Zhang et al. | |
| 2009/0217653 | A1 * | 9/2009 | Zhang | E02F 9/2217 60/414 |
| 2012/0151904 | A1 | 6/2012 | Shang et al. | |
| 2013/0000289 | A1 * | 1/2013 | Zhang | F15B 1/02 60/327 |
| 2013/0081704 | A1 * | 4/2013 | Opdenbosch | E02F 9/2217 137/14 |
| 2013/0195597 | A1 * | 8/2013 | Imura | E02F 9/123 414/744.2 |

FOREIGN PATENT DOCUMENTS

| | | |
|---|---|---|
| JP | S61-013004 U | 1/1986 |
| JP | 2000-204604 | 7/2000 |
| JP | 2003-222105 | 8/2003 |
| JP | 2005-003183 | 1/2005 |
| JP | 2010-121726 | 6/2010 |
| JP | 2011-514954 | 5/2011 |
| JP | 2012-102881 | 5/2012 |

OTHER PUBLICATIONS

International Search Report dated Nov. 12, 2013 (PCT/JP2013/071160).
International Search Report dated Nov. 12, 2013 (PCT/JP2013/071161).

* cited by examiner

FIG.5

| | SWING RECOVERY | SWING MOTORING | PUMP SUPPLYING | CYLINDER DRIVING | NO-LOAD |
|---|---|---|---|---|---|
| FIRST SELECTOR VALVE | COMMUNICATE | BLOCK | BLOCK | BLOCK | BLOCK |
| SECOND SELECTOR VALVE | BLOCK | COMMUNICATE | BLOCK | BLOCK | BLOCK |
| THIRD SELECTOR VALVE | COMMUNICATE | BLOCK | COMMUNICATE | COMMUNICATE | COMMUNICATE |
| FOURTH SELECTOR VALVE | BLOCK | BLOCK | BLOCK | COMMUNICATE | BLOCK |

SHOVEL

RELATED APPLICATION

This application is a continuation application of International Application No. PCT/JP2013/071161 filed on Aug. 5, 2013 and designated the U.S., which is based upon and claims the benefit of priority of Japanese Patent Application No. 2012-247868, filed on Nov. 9, 2012, the entire contents of which are incorporated herein by reference.

BACKGROUND

Technical Field

The present invention relates to a shovel provided with an accumulator.

Description of Related Art

In related art, there is a shovel provided with a swing hydraulic motor.

Normally, a hydraulic shovel that is provided with a swing hydraulic motor includes a relief valve in each of two conduit lines connecting two ports of the swing hydraulic motor and two ports of a flow control valve for the swing hydraulic motor. The relief valve ejects a working oil within the conduit line to a tank in a case in which a pressure of the working oil within the conduit line becomes a predetermined swing relief pressure or higher. The pressure of the working oil within the conduit line often exceeds the predetermined relief pressure when the working oil discharged from a main pump at a time of a swing acceleration is supplied to a driving side (suction side) of the swing hydraulic motor via one of the two conduit lines.

However, the ejection of the working oil to the tank via the relief valve wastes the working oil discharged from the main pump, and this is not an efficient method of utilizing the working oil.

SUMMARY

According to one embodiment of the present invention, there is provided a shovel including a swing hydraulic motor; a relief valve provided on the swing hydraulic motor; and a working oil supply source configured to supply to the swing hydraulic motor a working oil having a pressure lower than a relief pressure of the relief valve.

BRIEF DESCRIPTION OF THE DRAWINGS

FIG. 5 is a correspondence table indicating a corresponding relationship of states of the hydraulic circuit of FIG. 3 and states of each of selector valves;

DETAILED DESCRIPTION

A description will hereinafter be given of embodiments of the present invention with reference to the drawings.

In view of the related art described above, it is desirable to provide a shovel that can more efficiently utilize the working oil in the swing hydraulic motor.

Embodiment

Figure 1:
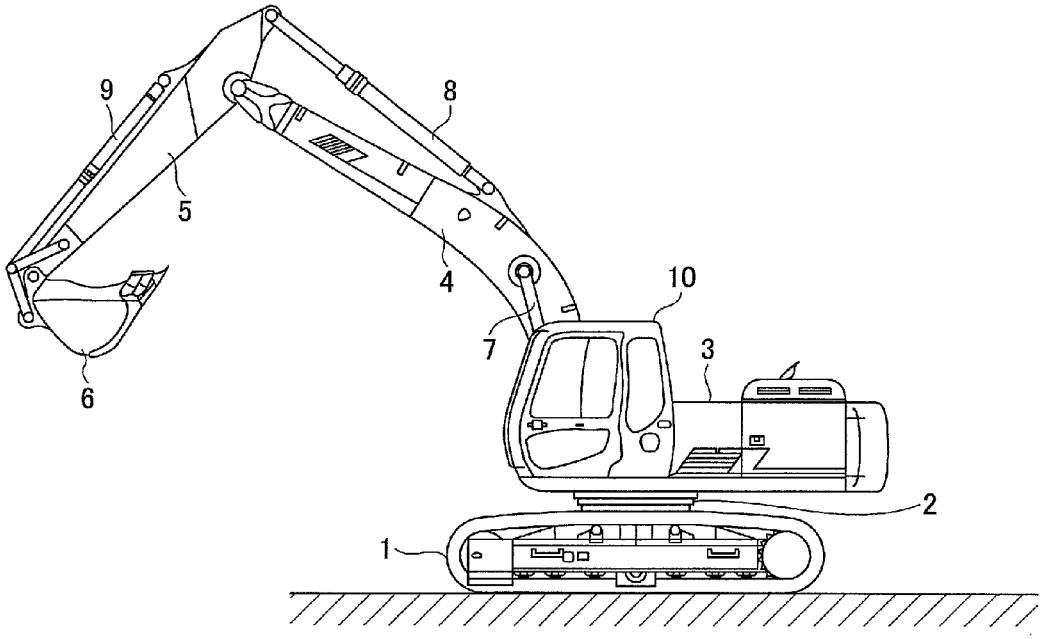
FIG. 1 is a side view of a hydraulic shovel according to one embodiment of the present invention.

FIG. 1 is a side view of a hydraulic shovel according to one embodiment of the present invention.

An upper structure can be mounted on a lower structure of the hydraulic shovel via a slewing mechanism 2. A boom 4 can be mounted on the upper structure 3. An arm 5 can be mounted on a tip end of the boom 4, and a bucket 6 can be mounted on a tip end of the arm 5. The boom 4, the arm 5, and the bucket 6 may form an attachment. The boom 4, the arm 5, and the bucket 6 may be respectively driven hydraulically by a boom cylinder 7, an arm cylinder 8, and a bucket cylinder 9 which can be hydraulic cylinders. A cabin 10 can be provided on the upper structure 3, and a driving source, such as an engine or the like, can also be provided on the upper structure 3.

Figure 2:
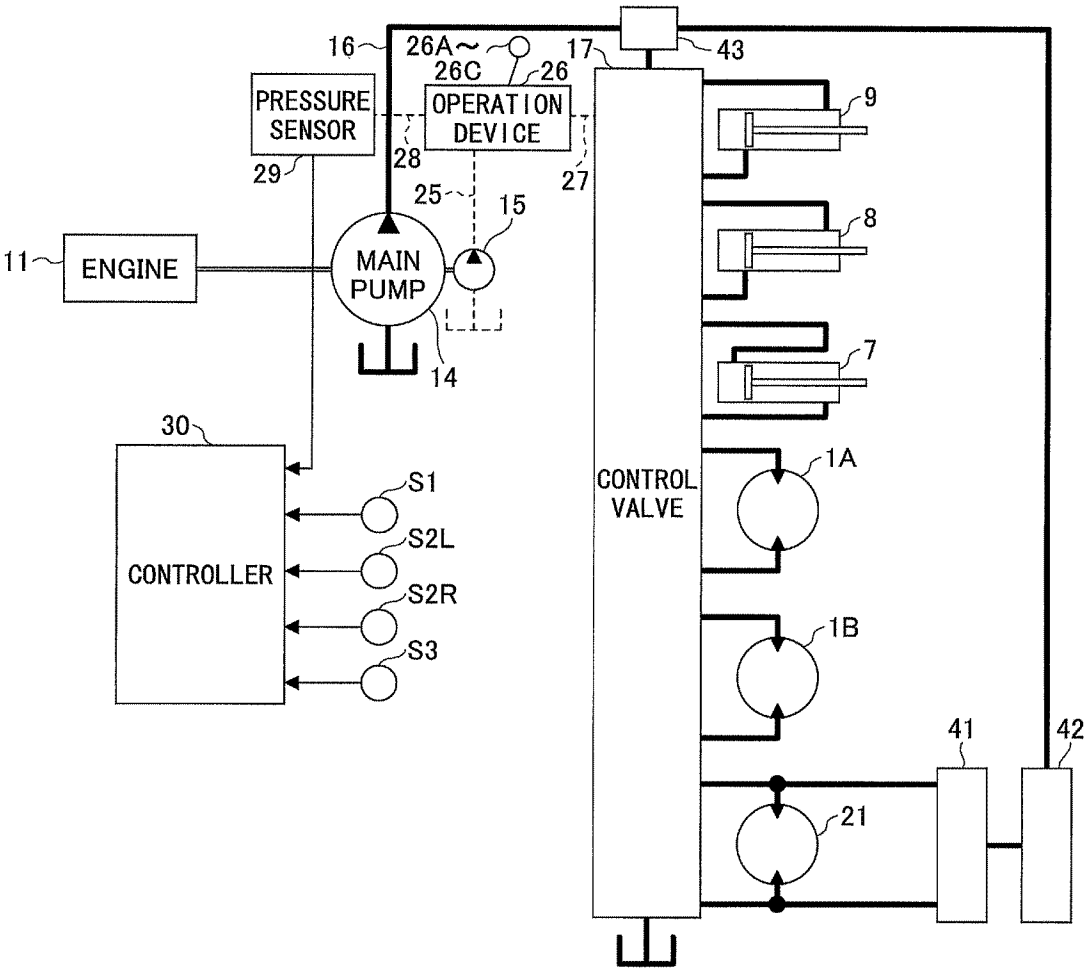
FIG. 2 is a block diagram illustrating a configuration of a driving system of the hydraulic shovel of FIG. 1.

FIG. 2 is a block diagram illustrating a configuration of a driving system of the hydraulic shovel of FIG. 1. In FIG. 2, a mechanical power system is indicated by a double line, a high-pressure hydraulic line is indicated by a bold solid line, a pilot line is indicated by a broken line, and an electrical drive and control system is indicated by a thin solid line.

A main pump 14 and a pilot pump 15, which may form a hydraulic pump, can be connected to an output shaft of an engine 11 which may form a mechanical drive part. A control valve 17 can be connected to the main pump 14 via a high-pressure hydraulic line 16 and a release switching part 43. In addition, an operation device 26 can be connected to the pilot pump 15 via a pilot line 25.

The control valve 17 can be a device for controlling a hydraulic system of the hydraulic shovel. Hydraulic actuators, such as hydraulic motors 1A (for the right side) and 1B (for the left side) of the lower structure 1, the boom cylinder 7, the arm cylinder 8, the bucket cylinder 9, a swing hydraulic motor 21, or the like can be connected to the control valve 17 via the high-pressure hydraulic line.

The operation device 26 may include a lever 26A, a lever 26B, and a pedal 26C. The lever 26A, the lever 26B, and the pedal 26C can be connected to each of the control valve 17 and a pressure sensor 29 via the hydraulic lines 27 and 28.

The pressure sensor 29 can be a sensor for detecting contents of an operation performed by an operator using the operation device 26. For example, the pressure sensor 29 may detect an operated direction and an operated amount of the lever or the pedal of the operation device 26 in the form of pressure, and output the detected value with respect to a controller 30. The contents of the operation performed from the operation device 26 may be detected using a sensor other than the pressure sensor.

The controller 30 may form a main control part for driving and controlling the hydraulic shovel. The controller 30 can be a device that is formed by a micro processor unit including a CPU (Central Processing Unit) and an internal memory, and may be realized by executing by the CPU a program for the driving and controlling, stored in the internal memory.

A pressure sensor S1 can be a sensor for detecting a discharge pressure of the main pump 14, and output the detected value with respect to the controller 30.

A pressure sensor S2L can be a sensor for detecting a pressure of a working oil on a side of a first port of the swing hydraulic motor 21, and output a detected value with respect to the controller 30.

A pressure sensor S2R can be a sensor for detecting a pressure of the working oil on a second port side of the swing hydraulic motor 21, and output a detected value with respect to the controller 30.

A pressure sensor S3 can be a sensor for detecting a pressure of the working oil in an accumulator part 42, and output a detected value with respect to the controller 30.

A first release and accumulation switching part 41 can be a hydraulic circuit element for controlling a flow of the working oil between the swing hydraulic motor 21 and the accumulator part 42.

The accumulator part 42 can be a hydraulic circuit element for accumulating excess working oil within the hydraulic circuit, and releasing the accumulated working oil according to needs, to form a working oil supply source.

The release switching part 43 can be a hydraulic circuit element for controlling a flow of the working oil amongst the main pump 14, the control valve 17, and the accumulator part 42.

A detailed description of the first release and accumulation switching part 41, the accumulator part 42, and the release switching part 43 will be given later.

Figure 3:
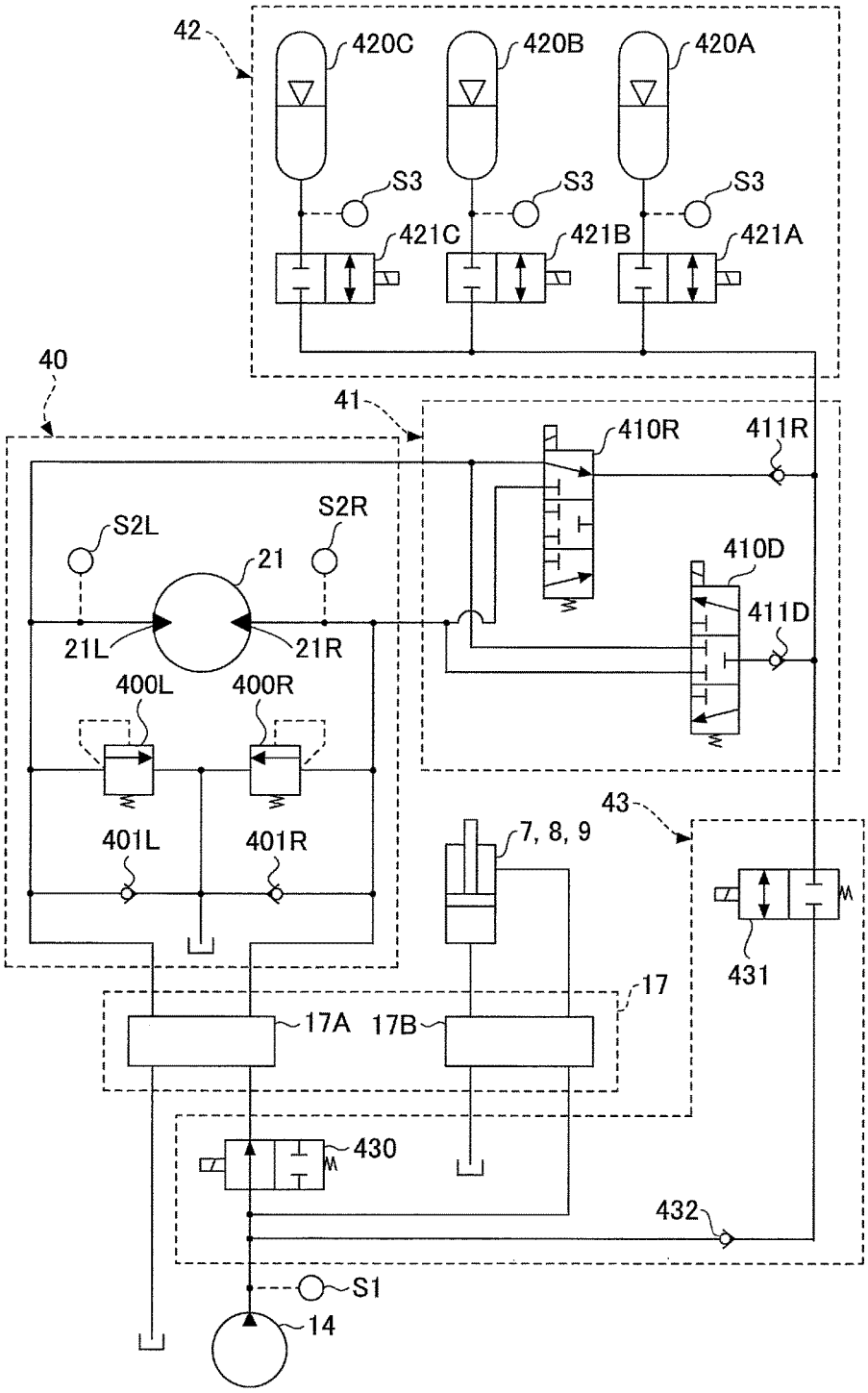
FIG. 3 is a diagram illustrating an example of a main configuration of a hydraulic circuit provided on the hydraulic shovel of FIG. 1.

Next, a description will be given of the accumulating and releasing of the accumulator part 42 that is provided on the hydraulic shovel of FIG. 1, by referring to FIG. 3. FIG. 3 is a diagram illustrating an example of a main configuration of a hydraulic circuit provided on the hydraulic shovel of FIG. 1.

The main configuration of the hydraulic circuit illustrated in FIG. 3 may mainly include a swing control part 40, the first release and accumulation switching part 41, the accumulator part 42, and the release switching part 43.

The swing control part 40 may mainly include the swing hydraulic motor 21, relief valves 400L and 400R, and check valves 401L and 401R.

The relief valve 400L can be a valve for preventing the pressure of the working oil on the side of a first port 21L of the swing hydraulic motor 21 from exceeding a predetermined swing relief pressure. More particularly, the relief valve 400L may eject the working oil on the side of the first port 21L to a tank in a case in which the pressure of the working oil on the side of the first port 21L reaches the predetermined swing relief pressure.

Similarly, the relief valve 400R can be a valve for preventing the pressure of the working oil on the side of a second port 21R of the swing hydraulic motor 21 from exceeding a predetermined swing relief pressure. More particularly, the relief valve 400R may eject the working oil on the side of the second port 21R to the tank in a case in which the pressure of the working oil on the side of the second port 21R reaches the predetermined swing relief pressure.

The check valve 401L can be a valve for preventing the working oil on the side of the first port 21L from becoming less than a tank pressure. More particularly, the check valve 401L may supply the working oil within the tank to the side of the first port 21L in a case in which the pressure of the working oil on the side of the first port 21L decreases to the tank pressure.

Similarly, the check valve 401R can be a valve for preventing the working oil on the side of the second port 21R from becoming less than the tank pressure. More particularly, the check valve 401R may supply the working oil within the tank to the side of the second port 21R in a case in which the pressure of the working oil on the side of the second port 21R decreases to the tank pressure.

The first release and accumulation switching part 41 can be a hydraulic circuit element for controlling a flow of the working oil between the swing control part 40 (swing hydraulic motor 21) and the accumulator part 42. In this embodiment, the first release and accumulation switching part 41 may mainly include a first selector valve 410R, a second selector valve 410D, and check valves 411R and 411D.

The first selector valve 410R can be a valve for controlling a flow of the working oil from the swing control part 40 to the accumulator part 42 at the time of an accumulation (recovery) operation of the accumulator part 42. In this embodiment, the first selector valve 410R can be a 3-port 3-position selector valve, and may be formed by a solenoid valve that switches a valve position thereof according to a control signal from the controller 30. In addition, the first selector valve 410R may be formed by a proportional valve that uses the pilot pressure. More particularly, the first selector valve 410R can have a first position, a second position, and a third position as the valve positions thereof. The first position can be the valve position for communicating the first port 21L and the accumulator part 42. Moreover, the second position can be the valve position for blocking the swing control part 40 and the accumulator part 42 from each other. Further, the third position can be the valve position for communicating the second port 21R and the accumulator part 42.

The second selector valve 410D can be a valve for controlling a flow of the working oil from the accumulator part 42 to the swing control part 40 at the time of a release (motoring) operation of the accumulator part 42. In this embodiment, the second selector valve 410D can be a 3-port 3-position selector valve, and may be formed by a solenoid valve that switches a valve position thereof according to a control signal from the controller 30. In addition, the second selector valve 410D may be formed by a proportional valve that uses the pilot pressure. More particularly, the second selector valve 410D can have a first position, a second position, and a third position as the valve positions thereof. The first position can be the valve position for communicating the accumulator part 42 and the first port 21L. Moreover, the second position can be the valve position for blocking the accumulator part 42 and the swing control part 40 from each other. Further, the third position can be the valve position for communicating the accumulator part 42 and the second port 21R.

The check valve 411R can be a valve for preventing a flow of the working oil from the accumulator part 42 to the swing control part 40. In addition, the check valve 411D can be a valve for preventing a flow of the working oil from the swing control part 40 to the accumulator part 42.

In the following description, a combination of the first selector valve 410R and the check valve 411R may be referred to as a first accumulator (recovery) circuit, and a combination of the second selector valve 410D and the check valve 411D may be referred to as a first release (motoring) circuit.

The accumulator part 42 can be a hydraulic circuit element for accumulating the excess working oil within the hydraulic circuit, and releasing the accumulated working oil according to the needs. More particularly, the accumulator part 42 may accumulate the working oil on a braking side (ejection side) of the swing hydraulic motor 21 during a swing deceleration, and release the working oil on a driving side (suction side) of the swing hydraulic motor 21 during a swing acceleration. In addition, the accumulator part 42 can also release the accumulated working oil to its hydraulic actuator during an operation of a hydraulic actuator other than that of the swing hydraulic motor 21. In this embodiment, the accumulator part 42 may mainly include a first accumulator 420A, a second accumulator 420B, a third accumulator 420C, a first on-off valve 421A, a second on-off valve 421B, and a third on-off valve 421C.

The first accumulator 420A, the second accumulator 420B, and the third accumulator 420C can be devices for accumulating the excess working oil within the hydraulic circuit, and releasing the accumulated working oil according to the needs. In this embodiment, each accumulator can be a bladder type accumulator that utilizes nitrogen gas, and accumulates or releases the working oil utilizing compressibility of the nitrogen gas and incompressibility of the working oil. Each of the accumulators can have an arbitrary capacity, and the capacities of the accumulators may all be the same or, may be different.

Further, in this embodiment, a maximum release pressure of the first accumulator 420A can be higher than a maximum release pressure of the second accumulator 420B, and the maximum release pressure of the second accumulator 420B can be higher than a maximum release pressure of the third accumulator 420C.

The "maximum release pressure" may refer to a maximum pressure releasable by the accumulator, and can be a pressure that is determined by a maximum pressure of the accumulator at the time of the accumulation (recovery) operation. In this embodiment, the maximum release pressure of the first accumulator 420A can be adjusted to a predetermined value by controlling the first on-off valve 421A to open and close. The maximum release pressures of the second accumulator 420B and the third accumulator 420C may be adjusted in a manner similar to the above.

The first on-off valve 421A, the second on-off valve 421B, and the third on-off valve 421C can be valves that open and close according to control signals from the controller 30, and control the accumulation and the release of the first accumulator 420A, the second accumulator 420B, and the third accumulator 420C, respectively.

During the swing deceleration, the controller 30 can open the first on-off valve 421A in a case in which a pressure on the braking side (ejection side) of the swing hydraulic motor 21 is higher than a pressure of the first accumulator 420A, and close the first on-off valve 421A in a case in which the pressure on the braking side (ejection side) of the swing hydraulic motor 21 is lower than the pressure of the first accumulator 420A. Hence, the controller 30 can prevent the working oil of the first accumulator 420A from flowing to the braking side (ejection side) of the swing hydraulic motor 21 during the swing deceleration. In addition, during the swing acceleration, the controller 30 can open the first on-off valve 421A in a case in which the pressure of the first accumulator 420A is higher than a pressure on the driving side (suction side) of the swing hydraulic motor 21, and close the first on-off valve 421A in the case in which the pressure of the first accumulator 420A is lower than the pressure on the driving side (suction side) of the swing hydraulic motor 21. For this reason, the controller 30 can prevent the working oil on the driving side (suction side) of the swing hydraulic motor 21 from flowing to the first accumulator 420A during the swing acceleration. The control of the on and off states of the second on-off valve 421B in relation to the second accumulator 420B, and the control of the on and off states of the third on-off valve 421B in relation to the third accumulator 420B may be performed in a manner similar to the above.

The release switching part 43 can be a hydraulic circuit element for controlling a flow of the working oil amongst the main pump 14, the control valve 17, and the accumulator part 42. In this embodiment, the release switching part 43 may mainly include a third selector valve 430, a fourth selector valve 431, and a check valve 432.

The third selector valve 430 can be a valve for controlling a flow of the working oil to the swing hydraulic motor 21 via the control valve 17. In this embodiment, the third selector valve 430 can be a 2-port 2-position selector valve, and may be formed by a solenoid valve that switches a valve position thereof according to a control signal from the controller 30. In addition, the third selector valve 430 may be formed by a proportional valve that uses the pilot pressure. More particularly, the third selector valve 430 can have a first position and a second position as the valve positions thereof. The first position can be the valve position for communicating the main pump 14 and the accumulator part 42 with respect to a flow control valve 17A for the swing hydraulic motor, within the control valve 17. Moreover, the second position can be the valve position for blocking the main pump 14 and the accumulator part 42 from the flow control valve 17A for the swing hydraulic motor.

The fourth selector valve 431 can be a valve for controlling a flow of the working oil from the accumulator part 42 to the control valve 17 at the time of the release (motoring) operation of the accumulator part 42. In this embodiment, the fourth selector valve 431 can be a 2-port 2-position selector valve, and a valve position thereof may be switched according to a control signal from the controller 30. More particularly, the fourth selector valve 431 can have a first position and a second position as the valve positions thereof. The first position can be the valve position for communicating the main pump 14 and the control valve 17 with respect to the accumulator part 42. Moreover, the second position can be the valve position for blocking the main pump 14 and the control valve 17 with respect to the accumulator part 42.

The check valve 432 can be a valve for preventing the working oil discharged from the main pump 14 from flowing to the accumulator part 42.

In the following description, a combination of the fourth selector valve 431 and the check valve 432 may be referred to as a second release (motoring) circuit.

Figure 4:
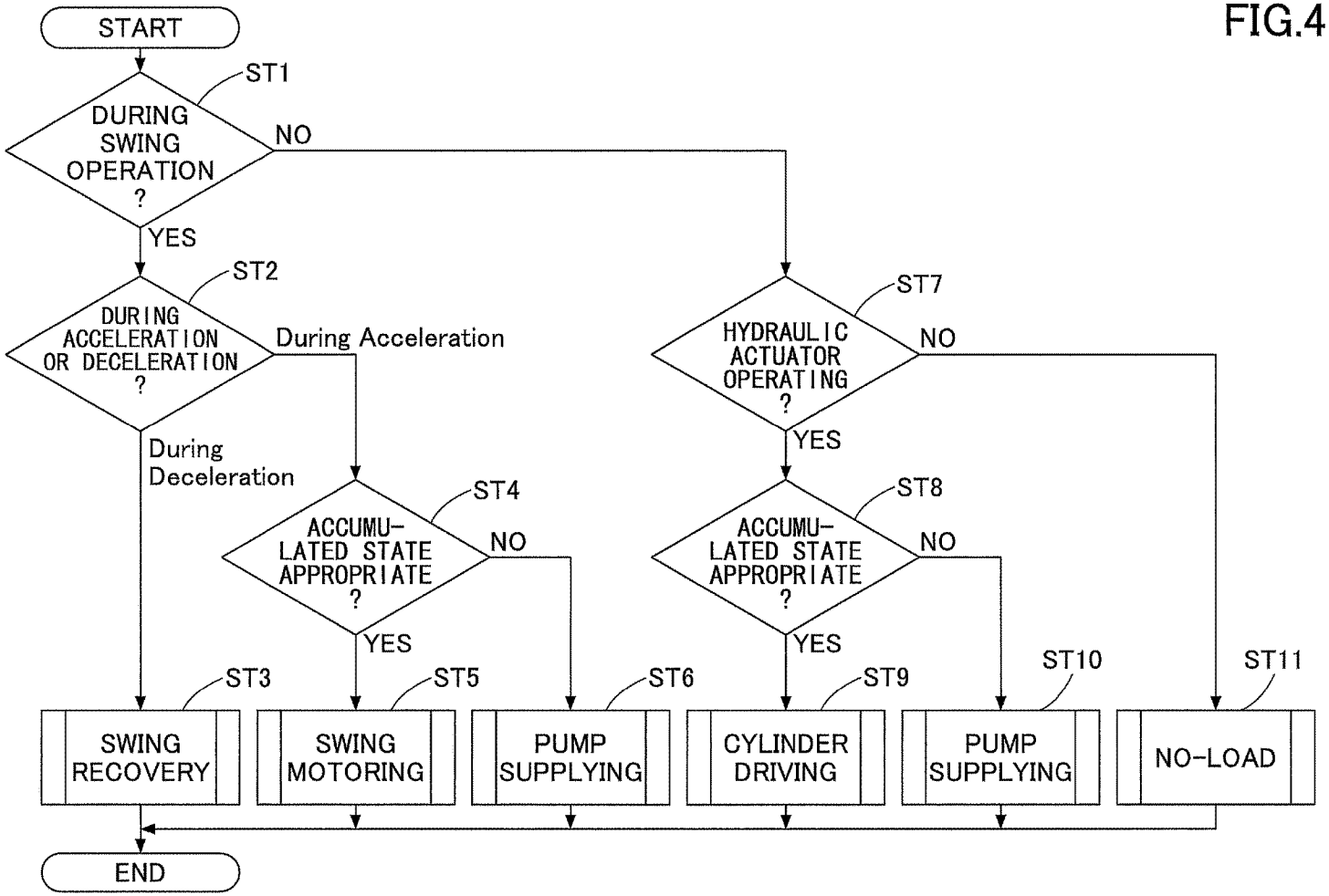
FIG. 4 is a flow chart illustrating a procedure of an accumulation and release process.

Next, a description will be given of a process (hereinafter referred to as an "accumulation and release process") in which the controller 30 controls the accumulation and release of the accumulator part 42, by referring to FIGS. 4 and 5. FIG. 4 is a flow chart illustrating a procedure of the accumulation and release process, and the controller 30 may repeatedly execute this accumulation and release process at a predetermined period. In addition, FIG. 5 is a correspondence table indicating a corresponding relationship of states of the hydraulic circuit of FIG. 3 and states of each of selector valves.

First, the controller 30 can judge whether it is during a swing operation of the hydraulic shovel, based on outputs of various kinds of sensors for detecting states of the hydraulic shovel (step ST1). In this embodiment, the controller 30 can judge whether it is during the swing operation of the hydraulic shovel, based on the operated amounts of the swing operation levers.

When it is judged that it is during the swing operation of the hydraulic shovel (YES in step ST1), the controller 30 can judge whether the hydraulic shovel is during a swing acceleration or a swing deceleration, based on the outputs of the various kinds of sensors (step ST2). In this embodiment, the controller 30 can judge whether it is during the swing acceleration or during the swing deceleration of the hydraulic shovel, based on the operated amounts of the swing operation levers.

When it is judged that it is during the swing deceleration (During Deceleration in step ST2), the controller 30 can control the state of the hydraulic circuit to a "swing recovery" state (step ST3).

As illustrated in FIG. 5, in the "swing recovery" state, the controller 30 can output the control signal with respect to the first selector valve 410R and control the first selector valve 410R to the first position or the third position thereof, in order to communicate the swing control part 40 and the accumulator part 42 via the first accumulator (recovery) circuit. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth selector valve 431 and control the fourth selector valve 431 to the second position thereof, in order to block the communication between the control valve 17 and the accumulator part 42. In the "swing recovery" state, the flow control valve 17A for the swing hydraulic motor, within the control valve 17, is in the blocking state, that is, in the state in which the communication between the swing hydraulic motor 21 and each of the main pump 14 and the tank is blocked. For this reason, even when the third selector valve 430 is in the first position thereof, the return oil from the swing hydraulic motor 21 will not be ejected to the tank via the flow control valve 17A for the swing hydraulic motor.

As a result, in the "swing recovery" state, the working oil on the braking side (ejection side) of the swing hydraulic motor 21 can flow to the accumulator part 42 via the first accumulator (recovery) circuit and can be accumulated in the accumulator part 42 (for example, the first accumulator 420A). In addition, because the fourth selector valve 431 is in the blocking state (second position) thereof, the working oil on the braking side (ejection side) of the swing hydraulic motor 21 will not flow to the control valve 17 via the fourth selector valve 431.

In step ST2, when it is judged that it is during the swing acceleration of the hydraulic shovel (During Acceleration in step ST2), the controller 30 can judge whether an accumulation state of the accumulator part 42 is appropriate (step ST4). In this embodiment, the controller 30 can judge whether the pressure of the working oil accumulated in the first accumulator 420A is higher than the pressure on the driving side (suction side) of the swing hydraulic motor 21, based on outputs of the pressure sensors S2L, S2R, and S3. The controller 30 can judge whether the accumulation state of the accumulator part 42 is appropriate, based on whether the pressure of the working oil accumulated in the first accumulator 420A is a predetermined pressure or higher.

In a case in which the accumulation state is judged to be appropriate, such as a case in which the pressure of the working oil accumulated in the first accumulator 420A is judged to be higher than the pressure on the driving side (suction side) of the swing hydraulic motor 21, for example (YES in step ST4), the controller 30 can control the state of the hydraulic circuit to a "swing motoring" state (step ST5).

As illustrated in FIG. 5, in the "swing motoring" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the first position or the third position thereof, in order to communicate the swing control part 40 and the accumulator part 42 via the first release (motoring) circuit. Moreover, the controller 30 can output the control signal with respect to the third selector valve 430 and control the third selector valve 430 to the second position thereof, in order to block the communication between the main pump 14 and the control valve 17. Further, the controller 30 can output the control signal with respect to the fourth selector valve 431 and control the fourth selector valve 431 to the second position thereof, in order to block the communication between the control valve 17 and the accumulator part 42.

As a result, in the "swing motoring" state, the working oil from the first accumulator 420A can be released to the driving side (suction side) of the swing hydraulic motor 21 via the first release (motoring) circuit, and the swing hydraulic motor 21 can be driven to swing. In addition, because the fourth selector valve 431 is in the blocking state (second position), the working oil of the first accumulator 420A will not flow to the control valve 17 via the fourth selector valve 431. In the "swing motoring" state, the controller 30 may output the control signal with respect to the third selector valve 430 and control the third selector valve 430 to the first position thereof, in order to provide a communication between the main pump 14 and the flow control valve 17A for the swing hydraulic motor. In this case, in addition to the working oil released from the first accumulator 420A, the working oil discharged from the main pump 14 can be supplied to the driving side (suction side) of the swing hydraulic motor 21.

In step ST4, in a case in which the accumulation state is judged not to be appropriate, such as a case in which the pressure of the working oil accumulated in the first accumulator 420A is judged to be lower than the pressure on the driving side (suction side) of the swing hydraulic motor 21, for example (NO in step ST4), the controller 30 can control the state of the hydraulic circuit to a "pump supplying" state (step ST6).

As illustrated in FIG. 5, in the "pump supplying" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the flow control valve 17A for the swing hydraulic motor. Further, the controller 30 can output the control signal with respect to the fourth selector valve 431 and control the fourth selector valve 431 to the second position thereof, in order to block the communication between the control valve 17 and the accumulator part 42.

As a result, in the "pump supplying" state, the working oil discharged from the main pump 14 can flow to the driving side (suction side) of the swing hydraulic motor 21, and the swing hydraulic motor 21 can be driven to swing. In addition, because the fourth selector valve 431 is in the blocking state (second position), the working oil discharged from the main pump 14 will not flow to the first accumulator 420A via the fourth selector valve 431.

In step ST1, when it is judged that it is not during the swing operation of the hydraulic shovel (NO in step ST1), the controller 30 can judge whether a hydraulic actuator other than the swing hydraulic motor 21 is operating, based on the outputs of the various kinds of sensors (step S7). In this embodiment, the controller 30 can judge whether the other hydraulic actuator is operating, based on operated amounts of operation levers of the other hydraulic actuator.

When it judged that the other hydraulic actuator (for example, the boom cylinder 7) is operating (YES in step ST7), the controller 30 can judge whether the accumulation state of the accumulator part 42 is appropriate (step ST8). In this embodiment, the controller 30 can judge whether the pressure of the working oil accumulated in the first accumulator 420A is higher than the pressure on a driving side of the boom cylinder 7, based on outputs of pressure sensors (not illustrated) for detecting the pressure of the working oil within the boom cylinder 7. The driving side of the boom cylinder 7 may refer to one of a bottom side oil chamber and a rod side oil chamber, having a volume that increases. The driving side of each of the arm cylinder 8 and the bucket cylinder 9 may similarly refer to the oil chamber having the volume that increases.

In a case in which the accumulation state is judged to be appropriate, such as a case in which the pressure of the working oil accumulated in the first accumulator 420A is judged to be higher than the pressure on the driving side of the boom cylinder 7, for example (YES in step ST8), the controller 30 can control the state of the hydraulic circuit to a "cylinder driving" state (step ST9).

As illustrated in FIG. 5, in the "cylinder driving" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the control valve 17. Further, the controller 30 can output the control signal with respect to the fourth valve 431 and control the fourth selector valve 431 to the first position thereof, in order to communicate the control valve 17 and the accumulator part 42 via the second release (motoring) circuit.

As a result, in the "cylinder driving" state, the working oil of the first accumulator 420A can be released to the driving side of the boom cylinder 7 via the second release (motoring) circuit and a flow control valve 17B for the boom cylinder. In addition, because the second selector valve 410D is in the blocking state (second position), the working oil of the first accumulator 420A will not flow to the swing control part 40 (swing hydraulic motor 21) via the second selector valve 410D.

In step ST8, in a case in which the accumulation state is judged not to be appropriate, such as a case in which the pressure of the working oil accumulated in the first accumulator 420A is judged to be lower than the pressure on the driving side of the boom cylinder 7, for example (NO in step ST8), the controller 30 can control the state of the hydraulic circuit to the "pump supplying" state (step ST10).

As illustrated in FIG. 5, in the "pump supplying" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the flow control valve 17A for the swing hydraulic motor. Further, the controller 30 can output the control signal with respect to the fourth selector valve 431 and control the fourth selector valve 431 to the second position thereof, in order to block the communication between the control valve 17 and the accumulator part 42.

As a result, in the "pump supplying", the working oil discharged from the main pump 14 can flow to the driving side of the boom cylinder 7, and drive the boom cylinder 7. In addition, because the fourth selector valve 431 is in the blocking state (second position), the working oil discharged from the main pump 14 will not flow to the first accumulator 420A via the fourth selector valve 431.

In step ST7, when it is judged that none of the other hydraulic actuators is operating (NO in step ST7), the controller 30 can control the state of the hydraulic circuit to a "no-load" state (step ST11).

As illustrated in FIG. 5, in the "no-load" state, the controller 30 can output the control signal with respect to the first selector valve 410R and control the first selector valve 410R to the second position thereof, in order to block the communication between the swing control part 40 and the accumulator part 42. In addition, the controller 30 can output the control signal with respect to the second selector valve 410D and control the second selector valve 410D to the second position thereof, in order to block the communication between the swing control part 40 and the accumulator part 42. Moreover, the controller 30 can output the control signal with respect to the third selector valve 430 and control the third selector valve 430 to the first position thereof, in order to communicate the main pump 14 and the flow control valve 17A for the swing hydraulic motor. Further, the controller 30 can output the control signal with respect to the fourth selector valve 431 and control the fourth selector valve 431 to the second position thereof, in order to block the communication between the control valve 17 and the accumulator part 42.

As a result, in the "no-load" state, a normal state in which the working oil discharged from the main pump 14 can be ejected to the tank via the control valve 17 may be obtained. In addition, because the fourth selector valve 431 is in the blocking state (second position), the working oil of the first accumulator 420 will not flow to the control valve 17 via the fourth selector valve 431.

Figure 6:
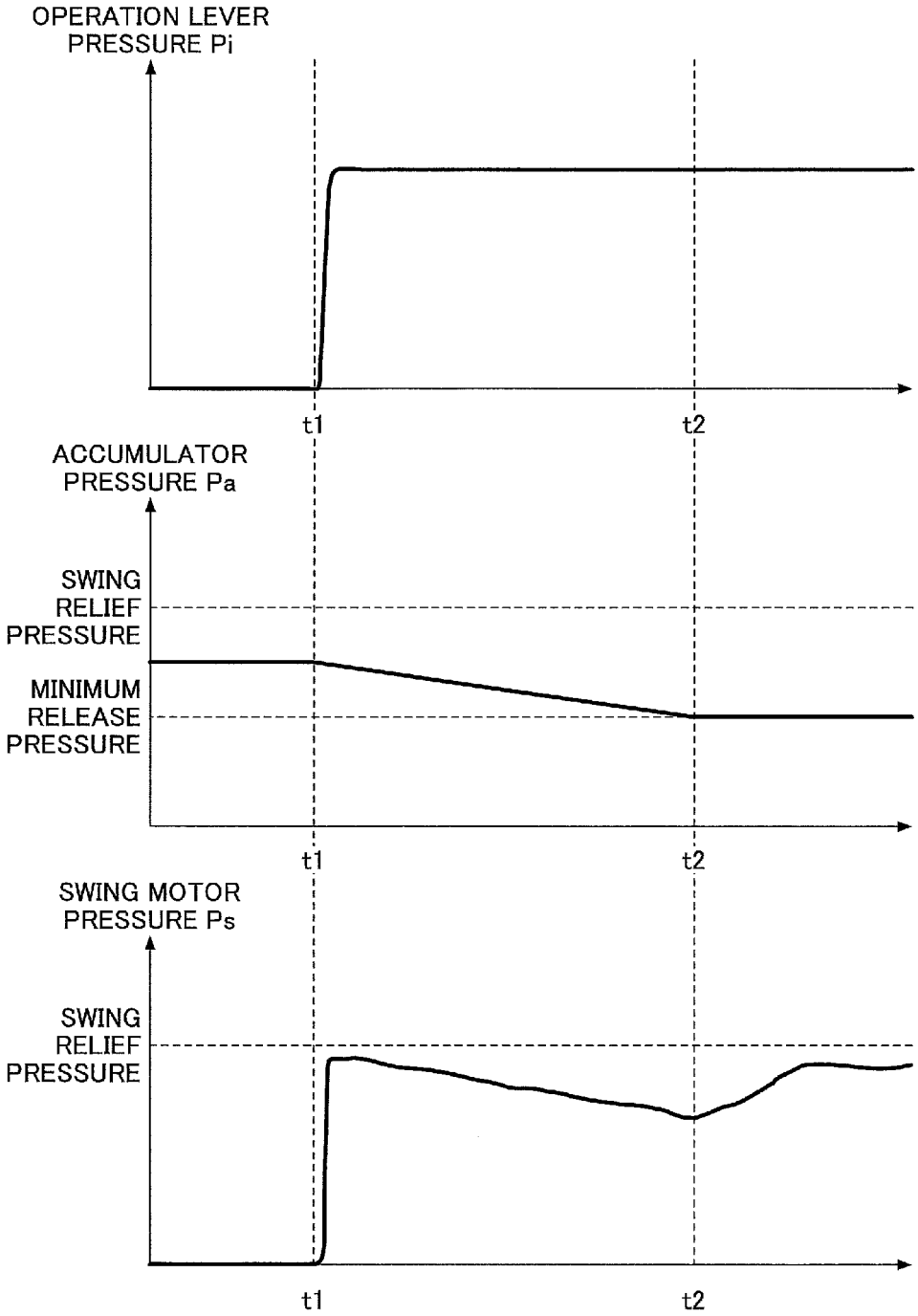
FIG. 6 is a diagram illustrating an example of changes in various pressures with lapse of time, at a time of a release of an accumulator of FIG. 3.

Next, a description will be given of a process in which the controller 30 controls the release of the accumulator part 42 when driving the swing hydraulic motor 21 to swing, by referring to FIG. 6. FIG. 6 is a diagram illustrating an example of changes in an operation lever pressure Pi, an accumulator pressure Pa, and a swing motor pressure Ps with lapse of time, at a time of the release (motoring) of the accumulator part 42. In this embodiment, the change in the operation lever pressure Pi an upper part of FIG. 6 indicates the change in the pilot pressure that varies according to the operation of the swing operation lever. In addition, the change in the accumulator pressure Pa in a middle part of FIG. 6 indicates the change in the pressure of the accumulator part 42 derived from a detected value of the pressure sensor S3. The pressure of the accumulator part 42 may refer to the pressure of one of the three accumulators. Further, the change in the swing motor pressure Ps in a lower part of FIG. 6 indicates the change in a detected value of the pressure sensor S2L, that is, the pressure on the driving side (suction side) of the swing hydraulic motor 21.

At the time t1, when the swing operation lever is tilted from a neutral position, the operation lever pressure Pi increases up to the pressure according to the tilted amount of the lever. In addition, the controller 30 can control the state of the hydraulic circuit to the "swing motoring" state.

When the state of hydraulic circuit becomes the "swing motoring" state, the working oil of the accumulator part 42 can be released to the driving side (suction side) of the swing hydraulic motor 21 via the first release (motoring) circuit and drive the swing hydraulic motor 21 to swing. For this reason, the accumulator pressure Pa starts to decrease, as illustrated in the middle part of FIG. 6.

In addition, because the third selector valve 430 is in the blocking state (second position), the working oil discharged from the main pump 14 will not flow to the driving side (suction side) of the swing hydraulic motor 21 via the flow control valve 17A for the swing hydraulic motor.

For this reason, at the time of a composite operation of the swing hydraulic motor 21 and the other hydraulic actuator (for example, the boom cylinder 7), even in a case in which the pressure of the other hydraulic actuator is lower than the pressure of the swing hydraulic motor 21, it is possible to positively supply the working oil to the swing hydraulic motor 21 having the high pressure. Consequently, even at the time of the composite operation, it is possible to maintain easy operation of the swing hydraulic motor 21.

In addition, because the controller 30 can release the working oil of the accumulator part 42 to the driving side of the swing hydraulic motor 21 according to the operation of the swing operation lever at a time t1, it is possible to prevent the working oil from being ejected and wasted via the relief valve 400L. This is because the accumulator pressure Pa will not exceed the predetermined swing relief pressure. More particularly, it is because the accumulator part 42 only accumulates the working oil on the braking side (ejection side) of the swing hydraulic motor 21, that is, the working oil that has the predetermined swing relief pressure or lower.

Thereafter, at the time t2, when the accumulator pressure Pa decreases to a predetermined minimum release pressure, the controller 30 can control the state of the hydraulic circuit to the "pump supplying" state.

When the state of the hydraulic circuit becomes the "pump supplying" state, the second selector valve 410D assumes the blocking state (second position), and the release of the working oil from the accumulator part 42 to the swing hydraulic motor 21 via the first release (motoring) circuit is blocked. For this reason, the accumulator pressure Pa remains at the minimum release pressure as indicated in the middle part of FIG. 6.

On the other hand, the third selector valve 430 is in the open state (first position), and the supply of the working oil from the main pump 14 to the swing hydraulic motor 21 via the flow control valve 17A for the swing hydraulic motor can be continued. The main pump 14 can increase the discharge by an amount corresponding to the amount of the working oil from the accumulator part 42, while maintaining the discharge pressure.

Accordingly, the controller 30 can drive the swing hydraulic motor 21 using the working oil from the main pump 14, while preventing the working oil from being ejected and wasted via the relief valve 400L.

Figure 7:
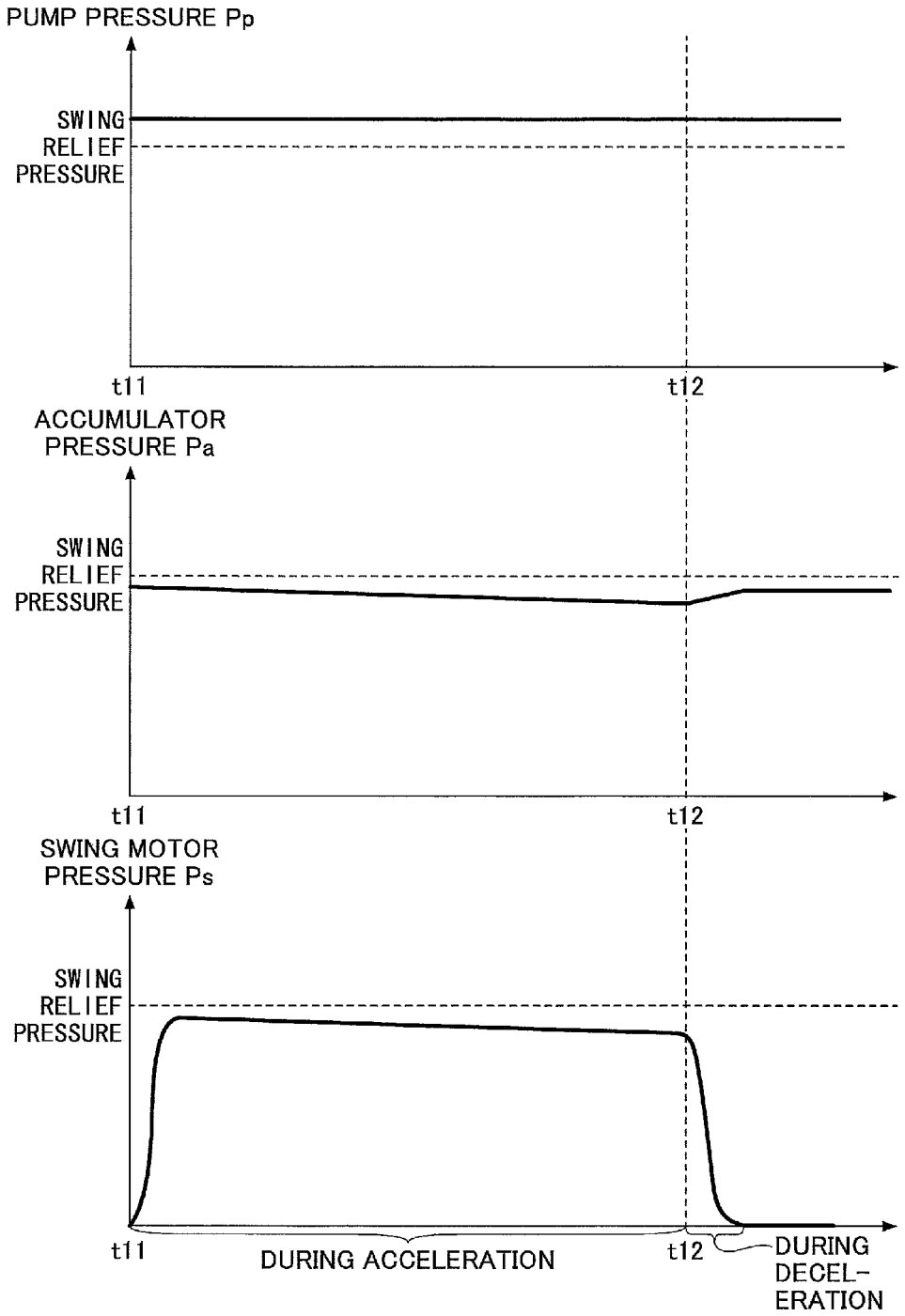
FIG. 7 is a diagram illustrating another example of the changes in the various pressures with the lapse of time, at the time of the release of the accumulator of FIG. 3.

Next, a description will be given of another process in which the controller 30 controls the release of the accumulator part 42, when driving the swing hydraulic motor 21 to swing, by referring to FIG. 7. FIG. 7 is a diagram illustrating an example of changes in a pump pressure Pp, an accumulator pressure Pa, and a swing motor pressure Ps with lapse of time, at a time of the release (motoring) of the accumulator part 42. In this embodiment, the change in the pump pressure Pp in an upper part of FIG. 7 indicates the change in the discharge pressure (detected value of the pressure sensor S1) of the main pump 14. In addition, the change in the accumulator pressure Pa in a middle part of FIG. 7 indicates the change in the pressure of the accumulator part 42 derived from a detected value of the pressure sensor S3. Further, the change in the swing motor pressure Ps in a lower part of FIG. 7 indicates the change in a detected value of the pressure sensor S2L, that is, the pressure on the driving side (suction side) of the swing hydraulic motor 21.

At a time t11, when the swing operation lever is tilted from a neutral position, the controller 30 can control the state of the hydraulic circuit to the "swing motoring" state, in a case in which the load of the main pump 14 is higher than a threshold value (for example, in a case in which the pump pressure Pp is higher than the swing relief pressure).

More particularly, when the controller 30 judges that the pump pressure Pp is higher than the swing relief pressure and the load of the main pump 14 is higher than the threshold value, as indicated in the upper part of FIG. 7, the controller 30 can control the state of the hydraulic circuit to the "swing motoring" state. The pump pressure Pp can become the swing relief pressure or higher in a case in which the load on the other hydraulic actuator, other than the swing hydraulic motor 21, is a high, for example.

When the state of hydraulic circuit becomes the "swing motoring" state, the working oil of the accumulator part 42 can be released to the driving side (suction side) of the swing hydraulic motor 21 via the first release (motoring) circuit and drive the swing hydraulic motor 21 to swing. For this reason, the accumulator pressure Pa starts to decrease, as illustrated in the middle part of FIG. 7.

In addition, because the third selector valve 430 is in the blocking state (second position), the working oil discharged from the main pump 14 will not flow to the driving side (suction side) of the swing hydraulic motor 21 via the flow control valve 17A for the swing hydraulic motor. For this reason, the swing motor pressure Ps can undergo the same change as the accumulator pressure Pa, while maintaining the state lower than the predetermined swing relief pressure.

Accordingly, because the controller 30 can release the working oil of the accumulator part 42 to the driving side of the swing hydraulic motor 21 according to the operation of the swing operation lever at the time t11, it is possible to prevent the working oil from being ejected and wasted via the relief valve 400L. This is because the accumulator pressure Pa will not exceed the predetermined swing relief pressure. More particularly, it is because the accumulator part 42 only accumulates the working oil on the braking side (ejection side) of the swing hydraulic motor 21, that is, the working oil that has the predetermined swing relief pressure or lower.

Thereafter, at a time t12, when the swing operation lever is returned to the neutral position, the controller 30 can control the state of the hydraulic circuit to the "swing recovery" state.

When the state of the hydraulic circuit becomes the "swing recovery" state, the working oil on the braking side (ejection side) of the swing hydraulic motor 21 can flow to the accumulator part 42 via the first accumulator (recovery) circuit. For this reason, the accumulator pressure Pa starts to increase as indicated in the middle part of FIG. 7.

On the other hand, on the driving side (suction side) of the swing hydraulic motor 21, the supply of the working oil from the accumulator part 42 stops. For this reason, the swing motor pressure Ps indicating the change in the detected value of the pressure sensor S2L, that is, the pressure on the driving side (suction side) of the swing hydraulic motor 21, decreases as illustrated in the lower part of FIG. 7.

In the "swing recovery" state, the flow control valve 17A for the swing hydraulic motor is in the blocking state, that is, the state in which the communication between the swing hydraulic motor 21 and each of the main pump 14 and the tank is blocked. For this reason, the pump pressure Pp can maintain the same pressure without being affected by the above, as illustrated in the upper part of FIG. 7.

Accordingly, the controller 30 can prevent the working oil from the main pump 14 and having the pressure higher than the predetermined swing relief pressure from being supplied to the swing hydraulic motor 21.

In other words, in a case in which the pump pressure Pp is higher than the swing relief pressure and the swing operation lever is fully operated, the controller 30 can supply the working oil of the accumulator part 42 to the swing hydraulic motor 21 in place of the working oil discharged from the main pump 14. As a result, it is possible to prevent the working oil discharged from the main pump 14 from being ejected and wasted via the relief valve 400L.

In addition, in a case in which the pump pressure Pp is higher than the swing relief pressure and the swing operation lever is slightly operated, the controller 30 can supply the working oil of the accumulator part 42 to the swing hydraulic motor 21 in place of the working oil discharged from the main pump 14. As a result, it is possible to prevent the working oil discharged from the main pump 14 from generating a pressure loss at the flow control valve 17A for the swing hydraulic motor.

Moreover, because the swing hydraulic motor 21 can be driven by the accumulator part 42, it is possible to supply all of the working oil discharged from the main pump 14 to the other hydraulic actuator (for example, the boom cylinder 7). Hence, it is possible to maintain easy operation of the other hydraulic actuator, while maintaining the easy operation of the swing hydraulic motor 21.

Accordingly, in a case in which the pump pressure Pp is higher than the swing relief pressure, the the controller 30 can drive the swing hydraulic motor 21 to swing using the working oil of the accumulator part 42, in each of the cases in which the swing operation lever is fully operated and slightly operated, in order to prevent hydraulic energy from being consumed and wasted, to thereby promote energy saving.

Figure 8:
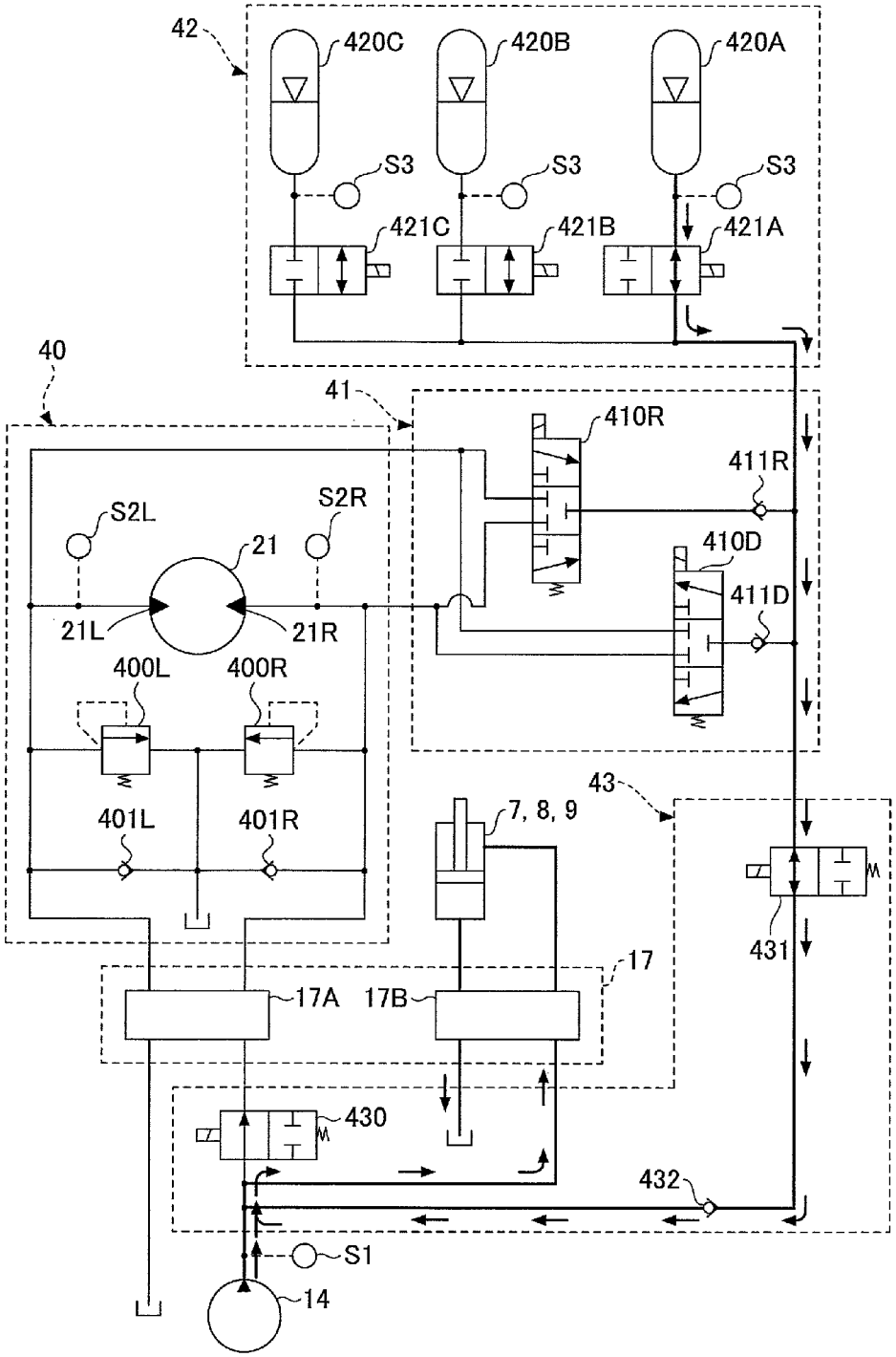
FIG. 8 is a diagram illustrating a flow of a working oil from an accumulator part to a hydraulic cylinder during a swing stop release process.

Next, a description will be given of a process (hereinafter referred to as a "release process at the time of swing stop") in which the controller 30 controls the release of the accumulator part 42, in order to operate the hydraulic actuator other than the swing hydraulic motor 21 during a swing stop, by referring to FIG. 8. FIG. 8 is a diagram corresponding to FIG. 3, and illustrates the flow of the working oil from the accumulator part 42 to the hydraulic cylinders 7, 8, and 9 during the release process at the time of swing stop. Although FIG. 8 illustrates the flow of the working oil from the first accumulator 420A to the hydraulic cylinders 7, 8, and 9, the working oil may be supplied from one, two, or three of the three accumulators to the hydraulic cylinders 7, 8, and 9.

When the boom operation lever is operated during the swing stop, the controller 30 can control the state of the hydraulic circuit to the "cylinder driving" state when the accumulation state of the accumulator part 42 is appropriate.

In the "cylinder driving" state, the controller 30 can output a control signal with respect to the first selector valve 410R and control the first selector valve 410R to the second position thereof, in order to block the communication between the swing control part 40 and the accumulator part 42. In addition, the controller 30 can output a control signal with respect to the second selector valve 410D and control the second selector valve 410D to the second position thereof, in order to block the communication between the swing control part 40 and the accumulator part 42. Moreover, the controller 30 can output a control signal with respect to the third selector valve 430 and control the third selector valve 430 to the first position thereof, in order to communicate the main pump 14 and the control valve 17. Further, the controller 30 can output a control signal with respect to the fourth selector valve 431 and control the fourth selector valve 431 to the first position thereof, in order to communicate the control valve 17 and the accumulator part 42 via the second release (motoring) circuit.

As a result, in the "cylinder driving" state, the working oil of the accumulator part 42 can be released to the driving side of the boom cylinder 7 via the second release (motoring) circuit and the flow control valve 17B for the boom cylinder, and drive the boom cylinder 7. In addition, because the second selector valve 410D is in the blocking state (second position), the working oil of the accumulator part 42 will not flow to the swing control part 40 (swing hydraulic motor 21) via the second selector valve 410D.

Accordingly, in a case in which the pressure of the working oil accumulated in the accumulator part 42 is higher than the pressure on the driving side of the boom cylinder 7, the controller 30 can cause the working oil of the accumulator part 42 to merge with the working oil discharged from the main pump 14. Consequently, the controller 30 can reduce a pump output of the main pump 14, and promote energy saving.

Figure 9:
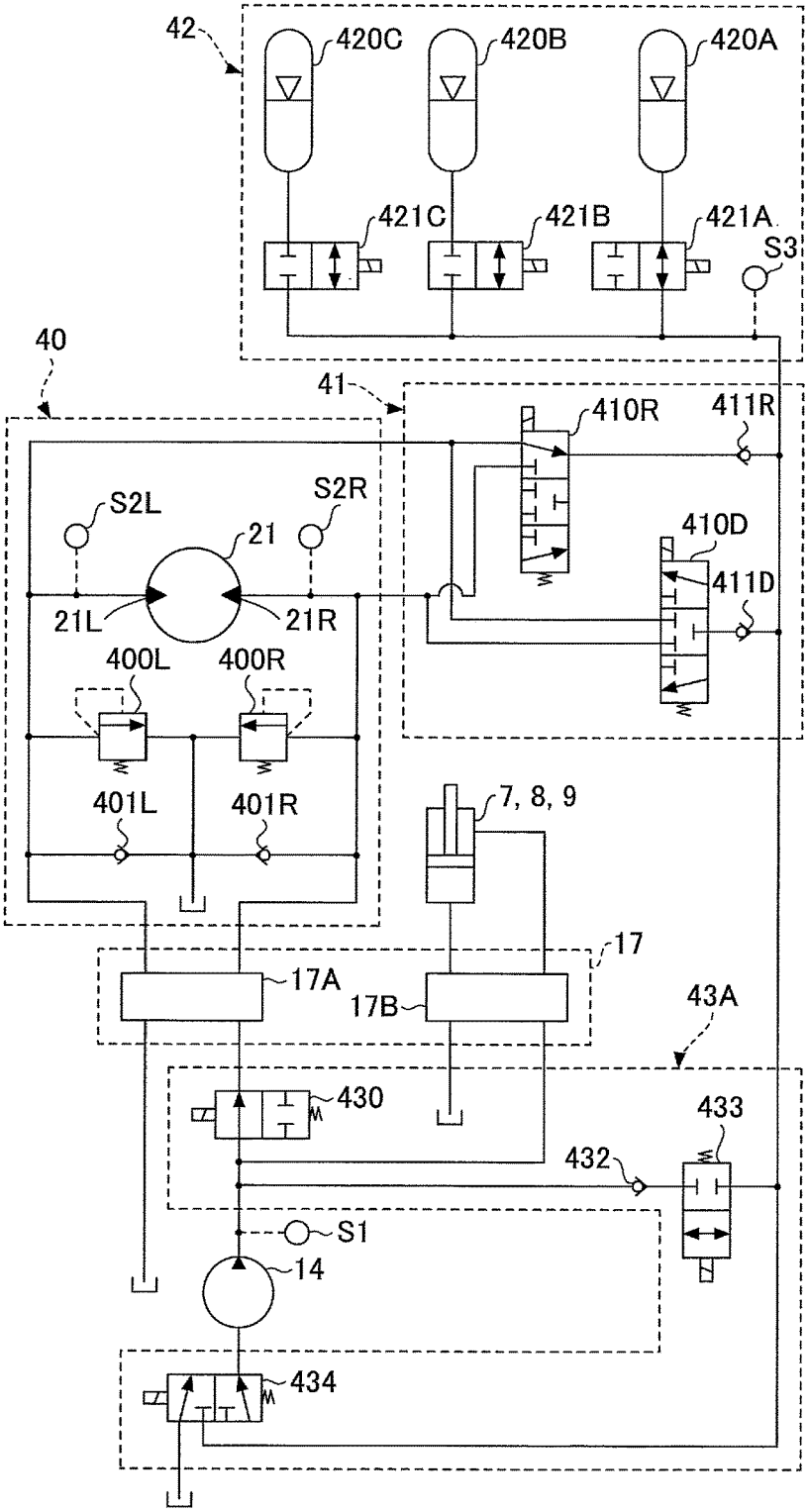
FIG. 9 is a diagram illustrating an example of another main configuration of the hydraulic circuit provided on the hydraulic shovel of FIG. 1.

Next, a description will be given of a process (hereinafter referred to as a "release process at time of low-pressure") in which the controller 30 controls the release of the accumulator part 42 in order to operate the hydraulic actuator, in a case in which the pressure of the accumulator part 42 is lower than the pressure on the driving side of the hydraulic actuator that is operating, by referring to FIGS. 9 and 10. FIG. 9 illustrates an example of another main configuration of the hydraulic circuit provided on the hydraulic shovel of FIG. 1.

The hydraulic circuit of FIG. 9 differs from the hydraulic circuit of FIG. 3, in that a release switching part 43A, including a fifth selector valve 433 and a sixth selector valve 434, is provided in place of the fourth selector valve 431. However, other parts of the hydraulic circuit of FIG. 9 are the same as those corresponding parts of the hydraulic circuit of FIG. 3. For this reason, a description of the same parts will be omitted, and a detailed description will be given on the differences.

The release switching part 43A that forms the second release (motoring) circuit can be a hydraulic circuit element for connecting the accumulator part 42 and the upstream side (suction side) or the downstream side (ejection side) of the main pump 14. In this embodiment, the release switching part 43A may include the fifth selector valve 433 and the sixth selector valve 434.

The fifth selector valve 433 can be a valve for controlling a flow of the working oil from the accumulator part 42 towards the control valve 17 via a junction point on the downstream side of the main pump 14, at the time of a release (motoring) operation of the accumulator part 42.

In this embodiment, the fifth selector valve 433 can be a 2-port 2-position selector valve, and may be formed by a solenoid valve that switches a valve position thereof according to a control signal from the controller 30. In addition, the fifth selector valve 433 may be formed by a proportional valve that uses the pilot pressure. More particularly, the fifth selector valve 433 can have a first position and a second position as the valve positions thereof. The first position can be the valve position for communicating the accumulator part 42 the control valve 17 via the junction point on the downstream side of the main pump 14. Moreover, the second position can be the valve position for blocking the accumulator part 42 and the control valve 17 from each other.

The sixth selector valve 434 can be a valve for controlling a flow of the working oil from the accumulator part 42 to the control valve 17 via the junction point on the upstream side of the main pump 14, at the time of the release (motoring) operation of the accumulator part 42.

In this embodiment, the sixth selector valve 434 can be a 2-port 2-position selector valve, and may be formed by a solenoid valve that switches a valve position thereof according to a control signal from the controller 30. In addition, the sixth selector valve 434 may be formed by a proportional valve that uses the pilot pressure. More particularly, the sixth selector valve 434 can have a first position and a second position as the valve positions thereof. The first position can be the valve position for communicating the accumulator part 42 and the control valve 17 via the junction point on the upstream side of the main pump 14. Moreover, the second position can be the valve position for blocking the accumulator part 42 and the control valve 17 from each other.

In a case in which the sixth selector valve 434 is at the first position thereof, communication between the main pump 14 and the tank is blocked, and communication can be provided between the main pump 14 and the accumulator part 42, on the upstream side of the main pump 14. The main pump 14 can suck in the working oil having the relatively high pressure released from the accumulator part 42, and eject this working oil towards the control valve 17. As a result, a suction horsepower (torque required to eject a predetermined amount of the working oil) of the main pump 14 can be reduced compared to a case in which the working oil having a relatively low pressure is sucked in from the tank and ejected, and it is possible to promote energy saving. Further, responsiveness of the main pump 14 in response to the control of the amount of ejection can be improved.

In addition, in a case in which the sixth selector valve 434 is at the second position thereof, communication can be provided between the main pump 14 and the tank, and communication between the main pump 14 and the accumulator part 42 is blocked, at the upstream side of the main pump 14. The main pump 14 can suck in the working oil having a relatively low pressure from the tank, and discharge this working oil towards the control valve 17.

At the time of the release (motoring) operation, the controller 30 can close the first release (motoring) circuit and open the second release (motoring) circuit 43A, in order to supply the working oil of the accumulator 42 to the control valve 17. Or, at the time of the release (motoring) operation, the controller 30 can open the first release (motoring) circuit and close the second release (motoring) circuit 43A, in order to supply the working oil of the accumulator part 42 to the swing hydraulic motor 21. At the time of the release (motoring) operation, the controller 30 may open both the first release (motoring) circuit and the second release (motoring) circuit 43A, in order to supply the working oil of the accumulator part 42 to both the swing hydraulic motor 21 and the control valve 17.

In a case in which the second release (motoring) circuit 43A is opened, the controller 30 can control one of the fifth selector valve 433 and the sixth selector valve 434 to the first position thereof, and the other to the second position thereof.

More particularly, when the hydraulic actuator is operated, the controller 30 can control the fifth selector valve 433 to the first position thereof and the sixth selector valve 434 to the second position thereof, in a case in which the pressure of the accumulator part 42 is higher than the pressure on the driving side of the hydraulic actuator. In addition, the controller 30 can release the working oil of the accumulator part 42 towards the control valve 17 via the junction point on the downstream side of the main pump 14.

Moreover, when the hydraulic actuator is operated, the controller 30 can control the fifth selector valve 433 to the second position thereof and the sixth selector valve 434 to the first position thereof, in a case in which the pressure of the accumulator part 42 is lower than the pressure on the driving side of the hydraulic actuator. Further, the controller 30 can release the working oil of the accumulator part 42 towards the main pump 14 via the junction point on the upstream side of the main pump 14. The main pump 14 can suck in the working oil released from the accumulator part 42 and discharge the working oil to the downstream side, instead of sucking in the working oil from the tank. As a result, the suction horsepower of the main pump 14 can be reduced compared to the case in which the working oil having the relatively low pressure is sucked in from the tank and ejected.

According to the configuration described above, the hydraulic circuit of FIG. 9 can obtain the effect of enabling the accumulator part 42 to perform the release (motoring) operation, even in a case in which the pressure of the accumulator part 42 is lower than the pressure on the driving side of the hydraulic actuator that is to be operated.

In addition, the hydraulic circuit of FIG. 9 has the configuration in which the working oil from the accumulator part 42 is merged at the junction point on the upstream side or at the junction point on the downstream side of the main pump 14. However, the embodiments are not limited to this configuration. For example, the second release (motoring) circuit 43A may omit the conduit line that includes the check valve 432 and the fifth selector valve 433, and the configuration may merge the working oil from the accumulator part 42 on at the junction point on the upstream side of the main pump 14.

Moreover, in a case in which the accumulation of all of the accumulators ends in the state in which the accumulation (recovery) operation is performed, or in a case in which a sufficient accumulation is already made in all of the accumulators at a point in time when the accumulation (recovery) operation is started, the return oil from the swing hydraulic motor 21 may be merged at the junction point on the upstream side or at the junction point on the downstream side of the main pump 14, using the second release and accumulation switching part 43A.

Figure 10:
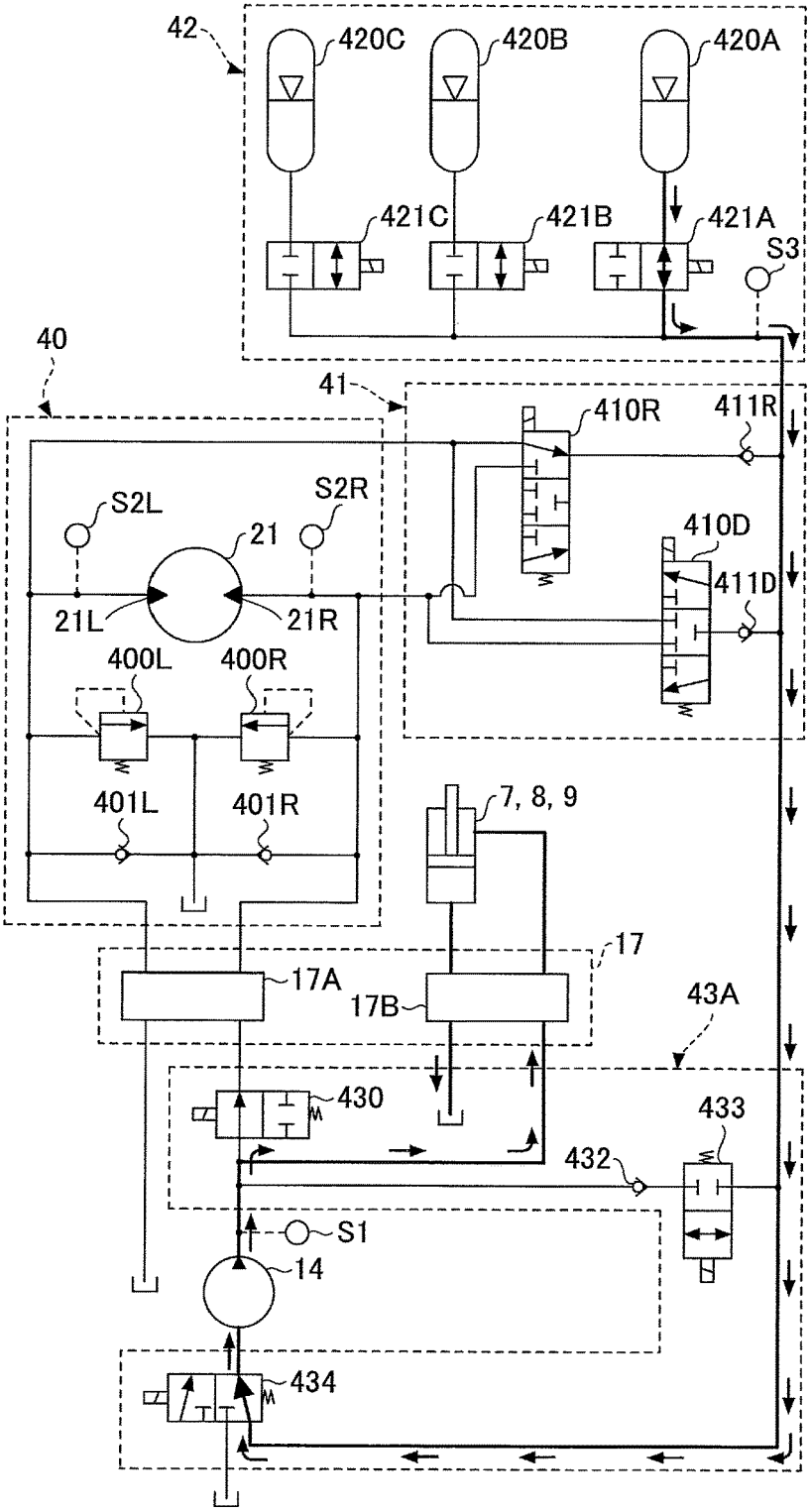
FIG. 10 is a diagram illustrating the flow of the working oil from the accumulator part to the hydraulic cylinder during a low-pressure release process.

FIG. 10 is a diagram corresponding to FIG. 9, and illustrates the flow of the working oil from the accumulator part 42 to the hydraulic cylinders 7, 8, and 9 during the release process at the time of low-pressure. Although FIG. 10 illustrates the flow of the working oil from the first accumulator 420A to the hydraulic cylinders 7, 8, and 9, the working oil may be supplied from one, two, or three of the three accumulators to the hydraulic cylinders 7, 8, and 9.

When the boom operation lever is operated, the controller 30 can output a control signal with respect to the fifth selector valve 433 and control the fifth selector valve 433 to the second position thereof in a case in which the pressure of the accumulator part 42 is lower than the pressure on the driving side of the boom cylinder 7, in order to block the communication between the downstream side of the main pump 14 and the accumulator part 42. In addition, the controller 30 can output a control signal with respect to the sixth selector valve 434 and control the sixth selector valve 434 to the first position thereof, in order to communicate the upstream side of the main pump 14 and the accumulator part 42.

As a result, the working oil of the accumulator part 42 can be released to the driving side of the boom cylinder 7 via the main pump 14 and the flow control valve 18B for the boom cylinder, and drive the boom cylinder 7.

Hence, in the case in which the pressure of the working on accumulated in the accumulator part 42 is lower than the pressure on the driving side of the boom cylinder 7, the controller 30 can cause the working oil of the accumulator part 42 to merge at the upstream side of the main pump 14. As a result, the controller 30 can reduce the suction horsepower of the main pump 14, and promote energy saving. The operation and effect in cases in which the hydraulic actuators other than the boom cylinder 7 are driven are the same as those described above.

According to the configuration described above, the hydraulic circuit according to the above described embodiment can suppress or prevent the working oil from being ejected via the relief valves 400L and 400R at the time of the swing acceleration. For this reason, it is possible to more efficiently utilize the working oil in the swing hydraulic motor.

The hydraulic circuit according to the above described embodiment can release the working oil accumulated in the accumulator part 42 not only to the swing hydraulic motor 21, but also to one or a plurality of other hydraulic actuators other than the swing hydraulic motor 21. For this reason, the hydraulic circuit according to the above described embodiment can efficiently utilize the hydraulic energy accumulated in the accumulator part 42.

In addition, in the above described embodiment, the controller 30 can control the flow of the working oil to the swing hydraulic motor 21 via the control valve 17, by switching the communicating and blocking states of the third selector valve 430. However, the embodiments are not limited to this configuration. For example, the controller 30 may control the flow of the working oil to the swing hydraulic motor 21 via the control valve 17 by adjusting the pilot pressure of the flow control valve 17A for the swing hydraulic motor by a proportional valve (not illustrated). More particularly, even in the case in which the swing operation lever is operated, the controller 30 may adjust the pilot pressure by the proportional valve according to the needs, and block the flow of the working oil to the swing hydraulic motor 21 via the flow control valve 17A for the swing hydraulic motor.

Moreover, in the above described embodiment, the controller 30 can judge whether the boom cylinder 7 is operating, after judging whether it is during the swing operation. Further, the controller 30 can release the working oil of the accumulator part 42 to the driving side of the boom cylinder 7 in the case in which the pressure of the accumulator part 42 is higher than the pressure on the driving side of the boom cylinder 7 that is operating. However, the embodiments are not limited to this configuration. For example, the controller 30 may judge whether the boom cylinder 7 is operating, before judging whether it is during the swing operation. In this case, when the pressure of the accumulator part 42 is higher than the pressure on the driving side of the boom cylinder 7 that is operating, the controller 30 can release the working oil of the accumulator part 42 to the driving side of the boom cylinder 7. In addition, when the boom cylinder 7 is not operating and the pressure of the accumulator part 42 is higher than the pressure on the driving side of the swing hydraulic motor 21 that is operating, the controller 30 can release the working oil of the accumulator part 42 to the driving side of the swing hydraulic motor 21.

Further, even when the pressure of the accumulator part 42 is lower than the pressure on the driving side of the boom cylinder 7 that is operating, the controller 30 can release the working oil of the accumulator part 42 to the driving side of the swing hydraulic motor 21 in a case in which the pressure of the accumulator part 42 is higher than the pressure on the driving side of the swing hydraulic motor 21 that is operating. Similarly, even when the pressure of the accumulator part 42 is lower than the pressure on the driving side of the swing hydraulic motor 21 that is operating, the controller 30 can release the working oil of the accumulator part 42 to the driving side of the boom cylinder 7 in a case in which the pressure of the accumulator part 42 is higher than the pressure on the driving side of the boom cylinder 7 that is operating. The relationship of the swing hydraulic motor 21 and the hydraulic actuators other than the boom cylinder 7 may be similar to the relationship described above for the boom cylinder 7.

In addition, in a case in which the hydraulic circuit of FIG. 9 is employed, the controller 30 can release the working oil accumulated in the accumulator part 42 towards a hydraulic actuator that is operating, even when the pressure of the working oil accumulated in the accumulator part 42 is lower than the pressure on the driving side of this hydraulic actuator that is operating.

The hydraulic circuit according to the above described embodiment can obtain the effect of enabling selection of the accumulator that is to become the accumulating destination, from the plurality of accumulators. More particularly, at the time of the accumulation (recovery) operation, the accumulator that is to become the accumulating destination can be made selectable from the plurality of accumulators having mutually different maximum release pressures, according to the pressure of the working oil on the braking side of the swing hydraulic motor 21. As a result, the accumulation (recovery) operation can be performed even when the pressure of the working oil on the braking side is low.

Moreover, at the time of the release (motoring) operation, the hydraulic circuit according to this embodiment enables selection of the accumulator that is to become the supply source of the working oil, from the plurality of accumulators having mutually different maximum release pressures, according to the required release pressure. As a result, it is possible to more efficiently utilize the accumulator having the low release pressure.

Further, the first accumulator 420A, the second accumulator 420B, and the third accumulator 420C may be set with a release pressure range that is determined by the maximum release pressure and a minimum release pressure. In this case, at the time of the accumulation (recovery) operation, the working oil on the braking side of the swing hydraulic motor 21 can be accumulated in the accumulator having the release pressure range suited for the pressure of the working oil on the braking side.

In addition, in this embodiment, one of the plurality of accumulators can be selected as the accumulating destination of the working oil at the time of the accumulation (recovery) operation, or as the supply source of the working oil at the time of the release (motoring) operation. In other words, the plurality of accumulators can accumulate or release at mutually different timings. For this reason, each of the plurality of accumulators can accumulate or release the working oil without being affected by the pressures of other accumulators. However, the embodiments are not limited to this configuration. For example, two or more accumulators may be simultaneously selected as the accumulating destination or the supply source. In other words, two or more accumulators may accumulate or release at partially or completely overlapping timings.

According to certain embodiments, it is possible to provide a shovel capable of efficiently using an accumulator.

Although the present invention is described in detail in conjunction with preferable embodiments, the present invention is not limited to the embodiments described above, and various modifications and substitutions may be made on the embodiments described above without departing from the scope of the present invention.

For example, in the embodiments described above, the working oil accumulated in the accumulator part 42 can be released towards the swing hydraulic motor 21, or one or a plurality of hydraulic actuators other than the swing hydraulic motor 21. However, the embodiments are not limited to this configuration. For example, the working oil accumulated in the accumulator part 42 may be released simultaneously towards the swing hydraulic motor 21, and the one or plurality of hydraulic actuators other than the swing hydraulic motor 21.

In addition, in the above described embodiments, the accumulator part may be employed as the supply source of the working oil, however, other hydraulic circuit elements, such as a separate hydraulic pump, a hydraulic booster, or the like, may be employed as the supply source.

What is claimed is:

1. A shovel comprising:

a main pump;

a swing hydraulic motor;

a relief valve provided on the swing hydraulic motor;

a working oil supply source configured to supply to the swing hydraulic motor a working oil having a pressure lower than a relief pressure of the relief valve;

a control valve configured to control a flow of the working oil between the main pump and the swing hydraulic motor; and a selector valve configured to switch between allowing and blocking communication between the main pump and the control valve, wherein the working oil supply source includes an accumulator part, which is connected between the control valve and the swing hydraulic motor, and is configured to release the working oil to the swing hydraulic motor when the selector valve blocks communication between the main pump and the control valve.

2. The shovel as claimed in claim 1, wherein the accumulator part accumulates the working oil on a braking side of the swing hydraulic motor.

3. The shovel as claimed in claim 1, wherein the accumulator part is formed by a plurality of accumulators.

4. The shovel as claimed in claim 1, wherein the accumulator part releases the working oil at a location upstream of the main pump.

5. The shovel as claimed in claim 1, wherein the selector valve, in a case in which the swing hydraulic motor is driven during driving of a hydraulic actuator other than the swing hydraulic motor, blocks the communication between the main pump and the control valve when a load on the main pump exceeds a threshold value.

6. The shovel as claimed in claim 5, wherein a load state of the main pump is judged based on a discharge pressure of the main pump.

7. The shovel as claimed in claim 5, wherein a load state of the main pump is judged based on a lever operation state of the hydraulic actuator.

8. A shovel comprising:

a main pump;

a swing hydraulic motor;

a relief valve provided on the swing hydraulic motor;

a working oil supply source configured to supply a working oil to the swing hydraulic motor at a pressure lower than a relief pressure of the relief valve;

a control valve configured to control a flow of the working oil between the main pump and the swing hydraulic motor; and a selector valve configured to switch between allowing and blocking communication between the main pump and the control valve, wherein the working oil supply source includes an accumulator part configured to release the working oil to the swing hydraulic motor when the selector valve blocks communication between the main pump and the control valve, and wherein the selector valve, in a case in which the swing hydraulic motor is driven during driving of a hydraulic actuator other than the swing hydraulic motor, blocks the communication between the main pump and the control valve when a load on the main pump exceeds a threshold value.

9. The shovel as claimed in claim 8, wherein a load state of the main pump is judged based on a discharge pressure of the main pump.

10. The shovel as claimed in claim 8, wherein a load state of the main pump is judged based on a lever operation state of the hydraulic actuator.

11. The shovel as claimed in claim 8, wherein the accumulator part is formed by a plurality of accumulators.

12. The shovel as claimed in claim 8, wherein the accumulator part releases the working oil at a location upstream of the main pump.

* * * * *